US006279903B1

(12) United States Patent
Mendes, Jr. et al.

(10) Patent No.: US 6,279,903 B1
(45) Date of Patent: Aug. 28, 2001

(54) AMUSEMENT GAME

(75) Inventors: John F. Mendes, Jr., Ormond Beach, FL (US); Michael J. Dobson, Mississauga (CA); Jack D. Cook, II, Ormond Beach, FL (US)

(73) Assignee: Bob's Space Racers, Inc., Daytona Beach, FL (US)

( * ) Notice: Subject to any disclaimer, the term of this patent is extended or adjusted under 35 U.S.C. 154(b) by 0 days.

(21) Appl. No.: 09/510,766

(22) Filed: Feb. 23, 2000

(51) Int. Cl.[7] ..... A63F 7/00

(52) U.S. Cl. ..... 273/121 B; 273/123 R; 273/126 R; 273/127 R

(58) Field of Search ..... 273/118 R, 118 A, 273/119 R, 119 A, 120 R, 120 A, 121 R, 121 A, 121 B, 122 R, 122 A, 123 R, 123 A, 124 R, 124 A, 125 R, 125 A, 126 R, 126 A

(56) References Cited

U.S. PATENT DOCUMENTS

| | | | | |
|---|---|---|---|---|
| 1,636,893 | * | 7/1927 | Biberfeld | 273/121 B |
| 3,825,265 | * | 7/1974 | Pitkanen et al. | 273/126 R |
| 4,199,143 | * | 4/1980 | Dieckhaus et al. | 273/121 A |
| 4,335,878 | | 6/1982 | Nishimiya . | |
| 5,016,879 | * | 5/1991 | Parker et al. | 273/126 A |
| 5,066,014 | | 11/1991 | Dobson . | |
| 5,137,278 | * | 8/1992 | Ritchie et al. | 273/118 A |
| 5,407,212 | | 4/1995 | Dobson . | |
| 5,439,230 | | 8/1995 | Mendes, Jr. et al. . | |
| 5,566,950 | | 10/1996 | Senna . | |
| 5,573,243 | | 11/1996 | Bartosik . | |
| 5,667,217 | | 9/1997 | Kelly et al. . | |
| 5,669,607 | | 9/1997 | Silver et al. . | |
| 5,678,823 | | 10/1997 | Chaffee et al. . | |
| 5,954,338 | | 9/1999 | Hampton . | |

* cited by examiner

*Primary Examiner*—Raleigh W. Chiu
(74) *Attorney, Agent, or Firm*—Standley & Gilcrest LLP

(57) ABSTRACT

An amusement game in which a game piece descends adjacent a playing surface. A preferred embodiment of the game includes a playing surface, a game piece, a plurality of deflecting members, and a receiving mechanism. The playing surface is preferably inclined. The deflecting members are preferably adapted to deflect the descending game piece. Nevertheless, the game piece is preferably adapted to descend past the deflecting members. The receiving mechanism is preferably positioned below the deflecting members. The receiving mechanism may have a recessed portion and a handle. The handle is preferably adapted to enable a player to move the recessed portion relative to the playing surface. Consequently, the player is preferably enabled to move the recessed portion to catch the game piece with the recessed portion.

20 Claims, 2 Drawing Sheets

AMUSEMENT GAME

BACKGROUND AND SUMMARY OF THE INVENTION

The present invention relates generally to an amusement game and, more particularly, to an amusement game in which a game piece (e.g., a small ball) descends randomly adjacent a playing surface and around a plurality of pins secured to the playing surface, to a movable catch device. A preferred embodiment of the game may be played by a single player, while a multiple player embodiment may also be provided. Moreover, the game of the present invention may be made in a variety of styles which will become apparent to one of ordinary skill in the art upon reading this disclosure.

A preferred embodiment of the game of the present invention comprises a playing surface (such as a sturdy flat panel, for example), a game piece (such as a steel ball, for example), a plurality of deflecting members (such as steel pins, for example), and a receiving mechanism or catch device (such as a plastic cup or scoop, for example). All of these components may be housed in an enclosure (such as a type similar to the enclosures used for well known electronic pinball machines, except that the enclosure need not be as deep horizontally as the cabinet found on those known enclosures) having a clear front surface that enables a player to visually watch the game piece descend along the playing surface. Such a front surface may be made of a hard, clear plastic, for example.

The receiving mechanism may be entirely or partially inside or outside the enclosure, as long as at least a portion of the receiving mechanism is positioned to receive the descending game piece as it nears the bottom of the playing surface. If the receiving mechanism is entirely inside the enclosure a handle is needed outside the enclosure to enable a player to manipulate the receiving mechanism to catch the game piece. The playing surface is preferably inclined in the vertical position, however, various angles off vertical may be used to vary the skill level required for the game. The game piece is preferably launched to a point near the top of the playing surface (such as, for example, by force of a spring launcher as is well known in electronic pinball machines to propel a pinball into play) and descends adjacent the playing surface by force of gravity. The deflecting members are preferably adapted to deflect the descending game piece in a random manner as the game piece descends vertically adjacent the playing surface. It should be noted here for clarification that while the game piece descends vertically overall, from time to time during its descent it will move horizontally momentarily as it strikes the deflecting members then returns to vertical by force of gravity until it strikes the next deflecting member below. It also should be noted here that use of the word vertical is not intended to imply purely vertical but is used generally to refer to a path of travel that includes a vertical component.

The game piece is preferably adapted to descend through (meaning around) and past the deflecting members. The receiving mechanism is preferably positioned below the last deflecting members. The receiving mechanism may have a recessed portion (e.g., a scoop) and a handle. The handle is adapted to enable a player to move the recessed portion laterally relative to the playing surface. Consequently, the player is preferably enabled to move the recessed portion to catch the game piece with the recessed portion as the game piece descends past the last of the pins (deflecting members).

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
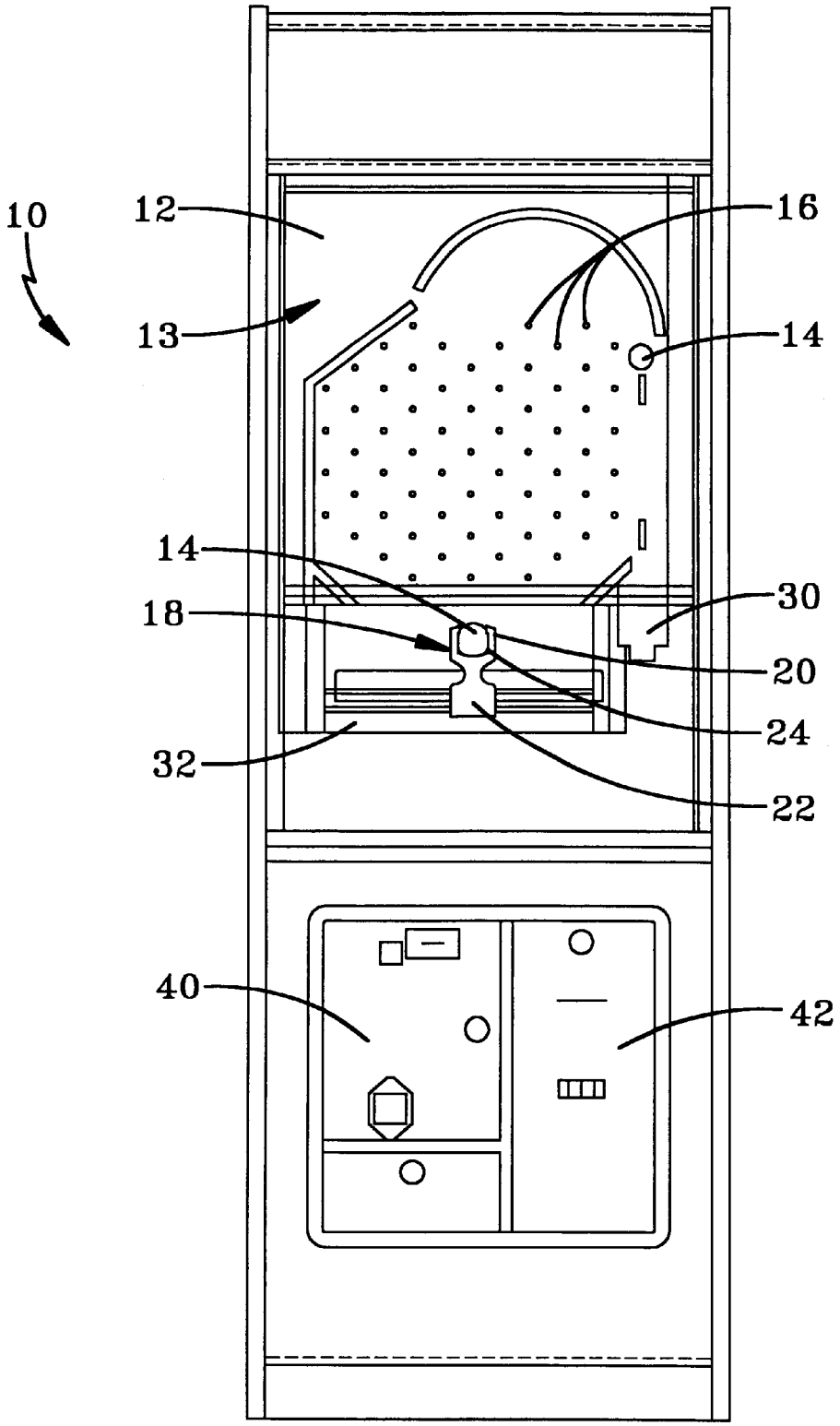
FIG. 1 is a front plan view of a preferred embodiment of an amusement game of the present invention.
Figure 2:
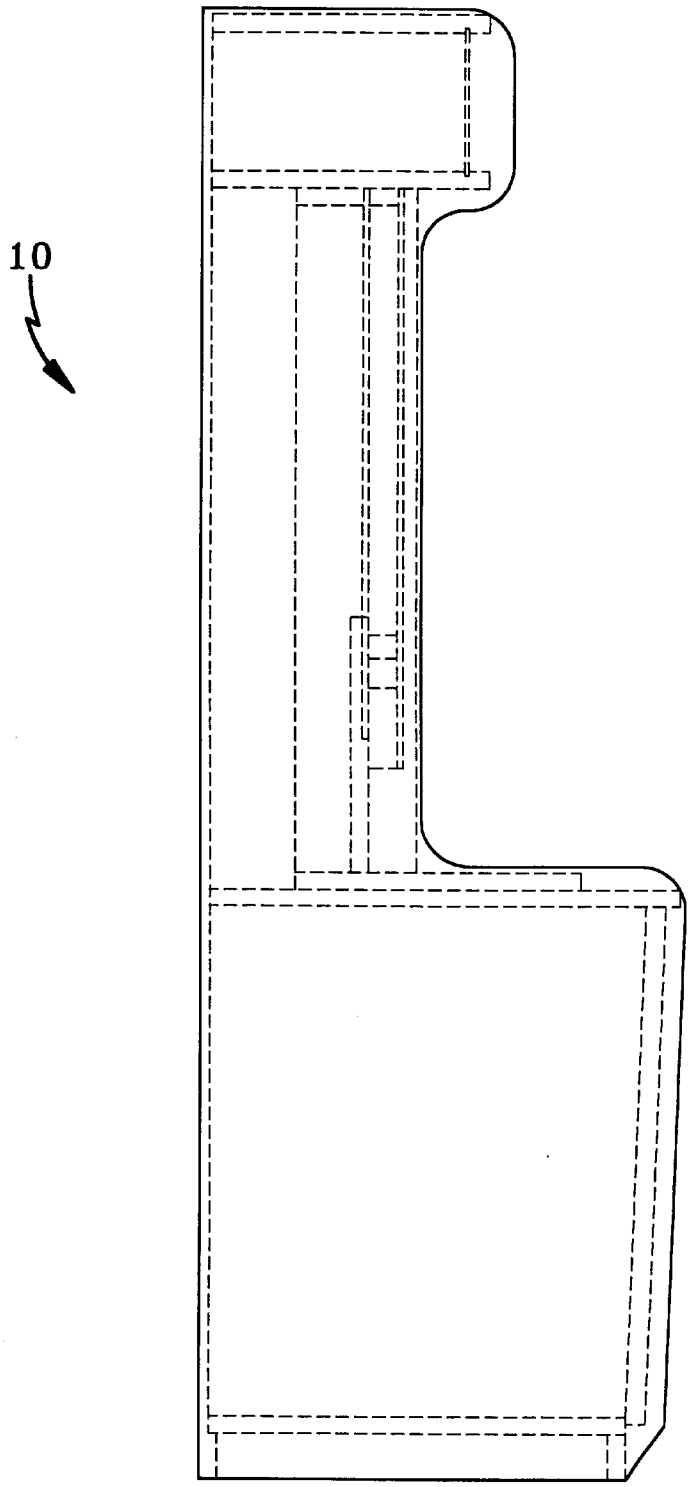
FIG. 2 is a cross sectional view of the amusement game of FIG. 1.

The present invention is directed to an amusement game in which a game piece is deflected as it descends adjacent a playing surface. FIGS. 1 and 2 illustrate a preferred embodiment of a game 10 of the present invention. A preferred embodiment of the game 10 includes a playing surface 12, at least one game piece 14, a plurality of deflecting members 16, and a receiving mechanism 18. It is preferred that the playing surface 12 is substantially vertical. However, it should be recognized that the playing surface 12 may have any suitable slope, contour, or inclination which will enable a game piece 14 to descend. The deflecting members 16 are preferably adapted to deflect a descending game piece 14. Nevertheless, a game piece 14 ultimately descends through the plurality of deflecting members 16. The receiving mechanism 18 is preferably positioned below the deflecting members 16. The receiving mechanism 18 may have a recessed portion 20 and a handle 22. The handle 22 is preferably adapted to enable a player to move the recessed portion 20 laterally relative to the playing surface 12. Consequently, the player is preferably enabled to move the recessed portion 20 to catch a descending game piece 14 with the recessed portion 20.

A game piece 14 may have practically any shape that enables it to deflect off of deflecting members 16 as it descends. It is preferred that a game piece 14 is a steel ball or a disk. Nevertheless, it should be recognized that a game piece 14 may have an irregular, non-symmetrical, and/or non-circular shape. It should also be recognized that a game piece 14 may have a shape which includes portions that are substantially flat. The game piece 14 need not be steel, however a metal is preferred in association with metal deflecting pins to add an element of sound to the game as the ball hits the pins.

The deflecting members 16 are preferably stationary. However, in order to increase the difficulty of the game 10, conventional technology may be utilized to cause the deflecting members 16 to pop out from the playing surface 12. It should also be recognized that conventional technology may be utilized to cause the deflecting members 16 to slide or otherwise move relative to the playing surface 12, or vice versa.

A deflecting member 16 may have practically any shape that enables it to deflect a descending game piece 14 which strikes it. A deflecting member 16 is preferably cylindrical. Other preferred examples of a deflecting member 16 include a pin, a peg, a column, a fm, a pole, a post, a rod, a bar, a shaft, a beam, a spike, a cone, and a triangle.

The deflecting members 16 may be arranged in practically any desired pattern. However, the deflecting members 16 are preferably arranged in offsetting columns and rows. As shown in FIG. 1, each column of the deflecting members 16 may be vertically staggered relative to adjacent columns of the deflecting members 16. It is further preferred that the distance between adjacent deflecting members 16 is sufficient to allow a game piece 14 to pass between adjacent deflecting members 16.

The recessed portion 20 of the receiving mechanism 18 may have any shape that enables it to stop and catch a descending game piece 14. It is preferred that the recessed portion 20 is substantially U-shaped such that it may receive a descending game piece 14. The recessed portion 20 may have a contact surface 24. The contact surface 24 may be substantially concave. After a descending game piece 14 is caught with the recessed portion 20, the receiving mechanism 18 is preferably adapted to release the game piece 14 so that a next descending game piece 14 may be caught.

In another embodiment of the present invention, multiple game pieces 14 may be moving adjacent the playing surface 12 at the same time. In one embodiment of the game, the game may end after a player fails to catch a predetermined number of game pieces 14. In another embodiment of the game, the game may end after a predetermined number of game pieces 14 have been played. In another embodiment the game may end after a preset time limit of play. In any embodiment a player's success rate at playing the game may be measured by the number of game pieces caught by the player during the game. Another preferred method of scoring the game is to require each player to deliver each caught game piece, with the receiving mechanism, to a delivery point 30 within the enclosure. In this embodiment the receiving mechanism is adapted to deliver and drop a received game piece in a predetermined location, then return to catch another game piece and repeat the cycle of catch, deliver, and drop-catch, deliver, and drop. The number of properly delivered and dropped balls may then account for the player's score. The game complexity and speed may be dramatically increased by launching additional game pieces during the same time that a delivery and drop is occurring on another game piece. In this manner as soon as the player returns the receiving mechanism to catch the next game piece, the next game piece is already at or near the last row of pins leaving the player little time to catch it before it drops into a trough 32.

The deflecting members 16 are preferably secured at one end to the playing surface 12. The game 10 may include a substantially transparent cover 13. The deflecting members 16 may be positioned between the transparent cover and the playing surface 12. In addition or in the alternative, the deflecting members 16 may be secured to the transparent cover. Due to the preferred staggered placement of the deflecting members 16, each game piece will descend in a fairly random manner leaving the player to guess where the game piece is most likely to be at the time it passes the last set of deflecting members.

It is preferred that the recessed portion 20 of the receiving mechanism 18 is positioned between the transparent cover and the playing surface 12. The transparent cover may define a cutout, and the handle 22 of the receiving mechanism 18 may extend through the cutout such that a player is enabled to maneuver the recessed portion 20 of the receiving mechanism 18.

In one example of a game 10 of the present invention, the recessed portion 20 is movable only in a substantially horizontal plane. However, it should also be recognized that the recessed portion 20 may be movable in a vertical direction as well as a horizontal direction if increased difficulty is desired.

The game 10 may further comprise an ejector mechanism (or launcher) which is adapted to advance (or propel) a game piece 14 to an upper area on the playing surface such that the game piece 14 descends through the deflecting members 16. The ejector mechanism may be a conventional mechanism. Ejector mechanisms are known in the art. The ejector mechanism may be spring-loaded, and it may be activated by the player or preset to launch automatically at various intervals. The ejector mechanism preferably propels a game piece 14 to a position above the deflecting members 16. For one example, the ejector mechanism may propel a game piece 14 from a position below some of the deflecting members 16 to a position above the deflecting members 16. In another embodiment, the ejector mechanism may simply drop a game piece 14 from a position above the deflecting members 16. It should also be recognized that an ejector mechanism may propel a game piece 14 into a side portion of the deflecting members 16.

A coin or token receiving box 40 may be incorporated into the present invention. Such boxes are well known in arcade games. The game may be controlled to be actuated only in the event that a coin or token is received into the box 40. In addition, a ticket dispenser 42 may be included into the game and may be in communication with said coin or token box to be activated only in the event a token or coin is placed in the box 40 to start a game. Such dispensers are well known in arcade games.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A game comprising:

a playing surface within an enclosure;

a game piece adapted to descend adjacent said playing surface and within said enclosure;

a plurality of deflecting members secured within said enclosure, adapted to deflect said game piece as said game piece descends;

a receiving mechanism positioned below said deflecting members, said receiving mechanism having a recessed portion and a handle, said handle adapted to enable a player to move said recessed portion relative to said playing surface to catch said game piece as it descends;

a delivery point within the enclosure and wherein said receiving mechanism is adapted to move to said delivery point and to deliver a caught game piece to said delivery point; and wherein a score is tabulated based on the number of game pieces delivered to said delivery point.

2. The game of claim 1 wherein said deflecting members are staggered pins.

3. The game of claim 1 wherein said game piece is a ball.

4. The game of claim 1 wherein said game piece is a disk.

5. The game of claim 1 wherein said deflecting members are arranged in columns.

6. The game of claim 5 wherein each column of said deflecting members is vertically staggered relative to adjacent columns of said deflecting members.

7. The game of claim 1 wherein said recessed portion of said receiving mechanism has a contact surface which is substantially concave.

8. The game of claim 1 wherein said deflecting members are secured to said playing surface.

9. The game of claim 1 further comprising:

a transparent cover, said deflecting members positioned between said transparent cover and said playing surface.

10. The game of claim 9 wherein said deflecting members are connected to said transparent cover.

11. The game of claim 10 wherein said recessed portion of said receiving mechanism is positioned between said transparent cover and said playing surface.

12. The game of claim 4 wherein:

said transparent cover defines a cutout; and said handle of said receiving mechanism extends through said cutout such that said player is enabled to laterally maneuver said recessed portion of said receiving mechanism.

13. The game of claim 1 further comprising:

an ejector mechanism adapted to advance said game piece such that said game piece descends through said deflecting members.

14. The game of claim 13 wherein said ejector mechanism is spring-loaded.

15. The game of claim 13 wherein said ejector mechanism propels said game piece to a position above said deflecting members.

16. The game of claim 13 wherein said ejector mechanism propels said game piece from a position below some of said deflecting members to said position above said deflecting members.

17. The game of claim 13 wherein said player activates said ejector mechanism.

18. The game of claim 1 wherein multiple game pieces are ejected so that the multiple game pieces descend simultaneously down said playing surface.

19. The game of claim 1 wherein said deflecting members are adapted to pop out of said playing surface.

20. A game comprising:

a playing surface within an enclosure;

a game piece adapted to descend adjacent said playing surface and within said enclosure;

a plurality of deflecting members secured within said enclosure, adapted to deflect said game piece as said game piece descends;

a receiving mechanism positioned below said deflecting members, said receiving mechanism having a recessed portion and a handle, said handle adapted to enable a player to move said recessed portion relative to said playing surface to catch said game piece as it descends;

a delivery point within the enclosure and wherein said receiving mechanism is adapted to move to said delivery point and to deliver a caught game piece to said delivery point;

wherein a score is tabulated based on the number of game pieces delivered to said delivery point; and wherein multiple game pieces are ejected so that the multiple game pieces descend simultaneously down said playing surface.

* * * * *

UNITED STATES PATENT AND TRADEMARK OFFICE

CERTIFICATE OF CORRECTION

PATENT NO. : 6279,903 B1
DATED : August 28, 2001
INVENTOR(S) : John F. Mendes, Jr. et al.

It is certified that error appears in the above-identified patent and that said Letters Patent is hereby corrected as shown below:

Column 2,
Line 59, please delete the letters "fm" and replace it with the word -- fin --.

Signed and Sealed this

Twelfth Day of March, 2002

*Attest:*

*Attesting Officer*

JAMES E. ROGAN
*Director of the United States Patent and Trademark Office*